US010190312B2

(12) United States Patent
Flotre et al.

(10) Patent No.: US 10,190,312 B2
(45) Date of Patent: Jan. 29, 2019

(54) SOUND ABSORBING MATERIAL, A METHOD FOR PRODUCTION OF THE SAME AND DEVICE FOR CUTTING APERTURES IN THE SOUND ABSORBING MATERIAL

(71) Applicants: DEAMP AS, Trondheim (NO); MLT—MICRO LASER TECHNOLOGY GMBH, Munich (DE); NOWOFOL KUNSTSTOFFPRODUKTE GMBH & CO., KG, Siegsdorf (DE); ACOUSTIC GRG PRODUCTS LTD., Kent (GB)

(72) Inventors: Bjorn Andre Flotre, Trondheim (NO); Silvia Elena Cirstea, Cambridgeshire (GB); Edwin Robert Toulson, Cambridgeshire (GB)

( * ) Notice: Subject to any disclaimer, the term of this patent is extended or adjusted under 35 U.S.C. 154(b) by 0 days.

(21) Appl. No.: 15/306,847

(22) PCT Filed: Apr. 29, 2015

(86) PCT No.: PCT/NO2015/000008

§ 371 (c)(1),
(2) Date: Oct. 26, 2016

(87) PCT Pub. No.: WO2015/167342

PCT Pub. Date: Nov. 5, 2015

(65) Prior Publication Data

US 2017/0044761 A1 Feb. 16, 2017

(30) Foreign Application Priority Data

Apr. 29, 2014 (NO) ..... 20140549

(51) Int. Cl.

| | |
|---|---|
| ***E04B 1/84*** | (2006.01) |
| ***G10K 11/162*** | (2006.01) |
| ***G10K 11/168*** | (2006.01) |
| *E04B 9/00* | (2006.01) |
| *E04B 1/82* | (2006.01) |

(52) U.S. Cl.
CPC ..... *E04B 1/8409* (2013.01); *G10K 11/162* (2013.01); *G10K 11/168* (2013.01); (Continued)

(58) Field of Classification Search
CPC ..... E04B 1/8409; E04B 9/001; E04B 2001/8414; E04B 2001/8438; (Continued)

(56) References Cited

U.S. PATENT DOCUMENTS 7,905,323 B2 * 3/2011 Larsen ..... G10K 11/172 181/286
2001/0050197 A1 12/2001 Wood
(Continued)

FOREIGN PATENT DOCUMENTS

| | | | |
|---|---|---|---|
| DE | 102011012222 | 1/2014 | |
| EP | 2015291 B1 | 11/2010 | |
| WO | 0068039 | 12/2001 | |
| WO | 2006101403 A1 | 9/2006 | |
| WO | WO 2013124069 A2 * | 8/2013 | ..... E04B 1/8209 |

*Primary Examiner* — Jeremy Luks
(74) *Attorney, Agent, or Firm* — Maxwell L. Minch; GrayRobinson, P.A.

(57) ABSTRACT

Sound absorbing material for use in rooms inside buildings. The material comprises a continuous polymeric film (11) having smooth surfaces, said film having a thickness (t) of about 0.1 to 0.3 mm. The film is provided with numerous substantially parallel discontinuous microslits (12) with a degree of perforation of from 0.3-3%. The microslits are cut with laser devices to produce a highly smooth and level surface. The film is tensioned in a frame (16) with a level film surface or curved film surface.

13 Claims, 3 Drawing Sheets

Figure 1B:
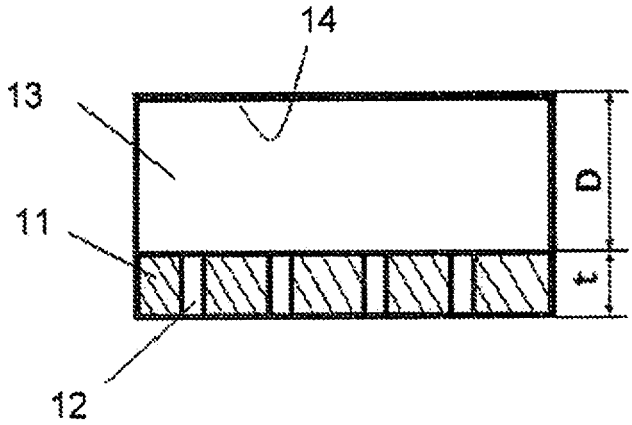

(52) U.S. Cl.
CPC ..... *E04B 9/001* (2013.01); *E04B 2001/8263* (2013.01); *E04B 2001/848* (2013.01); *E04B 2001/8452* (2013.01); *E04B 2001/8461* (2013.01)

(58) Field of Classification Search
CPC ..... E04B 2001/849; E04B 2001/8495; E04B 2001/8263; E04B 2001/8452
USPC ..... 181/30, 284, 286, 287, 290, 291, 293, 181/294, 295
See application file for complete search history.

(56) References Cited

U.S. PATENT DOCUMENTS

2008/0264720 A1* 10/2008 Vigran ..... E04B 1/86 181/286
2009/0050404 A1* 2/2009 Corin ..... F01N 1/083 181/279
2009/0277594 A1* 11/2009 Stewart ..... E06B 9/40 160/311
2012/0155688 A1* 6/2012 Wilson ..... G10K 11/168 381/354
2012/0285767 A1* 11/2012 Meyer ..... E04B 1/8209 181/286
2013/0037646 A1* 2/2013 Ohl ..... E06B 9/42 242/388
2014/0071662 A1* 3/2014 D'Antonio ..... E04B 9/32 362/147

* cited by examiner

SOUND ABSORBING MATERIAL, A METHOD FOR PRODUCTION OF THE SAME AND DEVICE FOR CUTTING APERTURES IN THE SOUND ABSORBING MATERIAL

The present invention concerns a sound absorbing material for dampening sound in buildings, a method of assembly of such a material, a method of production of such a material and a device for cutting apertures in the sound absorbing material.

BACKGROUND

The present invention is related to a sound dampening material for use indoor in buildings such as apartments, hospitals, shopping centers where people reside or move with the aim of dampening sound.

Numerous devices and materials for damping sound and noise in buildings are known from the prior art. One example can be found in U.S. Pat. No. 5,740,649 which describes a false ceiling for buildings designed to absorb acoustic waves. The ceiling is made up of hard plates of metal or plastic perforated with holes with a diameter of 0.2-3 mm. The plates are suspended in the ceiling. Another example of a sound absorbing material can be found in U.S. Pat. No. 3,094,188. This patent describes slabs to be mounted to for example a wall in a building. The slabs comprise a porous material perforated with recesses in the form of holes or slits with a given shape and depth to provide the desired acoustic impedance where the slab is to be mounted. FR 1 233 707 is a related publication. Yet another example of a sound dampening material can be found in U.S. Pat. No. 3,820,628. This patent describes through slits provided in the surface of a part of an air propulsor. Finally, EP 1 861 554 A1 describes a sound absorbent of a hard material, such as metal, glass or plastic in the form of panels provided with through microslits. U.S. Pat. No. 6,194,052 describes a sound absorbing sheet material of metal provided with numerous through microslits cut into the material. The microslits are produced by stamping or punching, which leaves an uneven surface which is susceptible to dust collection.

The sound dampening effect achieved by the apertures in the material is in general caused as follows: air in the apertures is put into vibration by the sound, whereupon the energy in the sound waves is converted into heat due to the friction of the viscous air flow in the apertures. To obtain this vibration of air in the slits, the sound absorbing material with its apertures is arranged at a certain distance from the object it is attached to, such as a ceiling. Then the air between the sound absorbing material and the object will fluctuate due to acoustic vibration. Accordingly, the sound dampening effect is obtained by a combination of viscous dissipation of the sound energy and Helmholtz absorption. The technology related to the sound dampening effect of constructions with apertures as mentioned above is not described in further detail here.

US 2001/0050197 A1 discloses a sound absorbing microperforated polymeric film. The material is embossed by a tool having posts. The embossed holes may for example be circular, square or hexagonal. There is no mention of any slits. However, the mechanical embossing process leaves deflections at the edge of the opening, providing an uneven surface that is more subject to dust collection than a level surface.

The article "Properties and Applications of Microperforated Panels" by Herrin et. al. is discussing micro perforated panels as acoustic absorbers. On page 6 it is stated that "Slit-shaped perforations have a slightly smaller acoustic resistance but function similar to circular holes for all practical purposes". Accordingly, the art suggests the use of holes instead of slits.

OBJECT

Accordingly, there is a need for a light-weight, flexible sound absorbing material that can be produced and transported at a low cost. Another object of the invention is to provide a sound absorbing material that requires only a fraction of the material consumption compared to production of prior art sound dampening devices. Moreover, it is an object of the present invention to provide a sound absorbing material that collects as little dust as possible. Moreover, it is an object of the present invention to provide a sound absorbing material that is flexible to assemble, particularly in buildings with complex geometry. It is also an object of the present invention to provide a sound absorbing material that is at least partially transparent to allow daylight to enter the area to be sound dampened. Another object is to dampen or spread daylight or artificial light emitted behind the film. Another object of the present invention is to provide a sound dampening effect that is equal to or even better than existing sound dampening materials. Yet another object of the present invention is to provide a sound absorbing material having good heat transfer capability and which is not producing noise when brought to vibrate or flutter.

THE INVENTION

The objects above are achieved by a sound absorbing material, a method of assembly, a method for production of and a device for cutting through apertures in the sound absorbing material, in accordance with the claims.

The sound absorbing material is a continuous polymeric film with smooth surfaces provided with numerous through microslits cut in the film to provide the sound dampening effect. The film may be provided in any desired geometry, such as square, rectangular etc. The side, length, width and density of the microslits are chosen in accordance with the characteristics of the space to be sound dampened, such as the geometry of the space in the building and the frequency of the sound to be damped. However, generally the polymeric film exhibit microslits with a degree of perforation of from 0.3-10%, preferably 0.3-5%, most preferably 0.3-3%. The term «film» is meant to include sheet of an at least partially translucent polymeric material with a continuous smooth surface having a thickness of about 0.1 to 0.3 mm and a flexibility that enables the material to be folded, rolled and conformed to objects at the space in the building to be sound dampened. Accordingly, the term "film" excludes self-supporting devices, such as panels. The film may be provided with any geometry, such as rectangular sheets provided with fastening means at least at two opposite edges of the film, to enable the sheet to be tensioned and mounted to the structure in question, such as a wall, a ceiling or any other suitable objects available at the building to be sound dampened. In use, the film is attached at a distance from the object, typically about 15 cm from the wall or similar.

In a preferred embodiment, the sound absorbing film in accordance with the invention is at least partially translucent, which makes the present invention particularly applicable in areas that require inflow of daylight from the surroundings, such as indoor shopping malls and reception halls in hotels. The film may be illuminated from the rear, i.e. illuminated by a light source arranged between the sound absorbing material and the structure, e.g. the ceiling.

The film is made of a polymer and optionally provided with particular additives, such as pigments and flame retardants. Examples of suitable materials are polypropylene (PP), polyethylene (PE), polycarbonate (PC), polystyrene (PS). Polyvinylchloride (PVC) is in general not wanted with respect to possible liberation of gaseous chlorine during any fire.

In a preferred embodiment, the polymer film is a PP film provided with a halogen-free flame retardant containing calcium hydrophosphite as the main component. Tests performed by the applicants that a film of this kind surprisingly produces no flames or drops. The tests were performed in accordance with EN 13823 by subjecting a PP film having an area weight of 160 g/m$^2$ and a nominal thickness of 180 μm. The film was provided with the commercially available flame retardant Resting HF delivered by Crosspolimeri S.p.A, Italy. The flame retardant can be included in the polymer film in numerous manners, which will be within the reach of a person skilled in the art.

Accordingly, a burning polymer film in a sound absorbing material according to this preferred embodiment of the invention produces no harmful halogens, such as chlorine and bromine, and produces no hot polymer drops that otherwise could fall down and hurt people or animals located under a burning film.

Thanks to the production method described in further detail below, the film exhibits smooth surfaces that minimize dust collection. This is particularly an advantage in hospitals, living rooms, etc. The dust needs longer time to deposit on the sound absorbing material, and the time between cleaning cycles will longer compared to rough surfaces. The composition and geometry of the sound absorbing material makes the sound absorbing material heat conductive, allowing heat to be exchanged between the structure and ambient air.

The sound absorbing material is provided as prefabricated element provided with a mounting device holding the film. The mounting device may be a frame, e.g., a square frame of wood, metal or polymer optionally provided with fastening means, such as holes for nails, bolts and similar, to enable the sound absorbing material to be mounted to the structure in question, e.g. a wall.

In another embodiment of the present invention, the frame is provided with one or more film tensioning means, such as pre-curved or bendable rods of metal whereupon the film in accordance with the invention is tensioned. In this manner, the sound absorbing film may be conformed to practically any shape. An example of a field of use is the ceiling of a shopping mall, where the ceiling is made up of windows to allow inflow of daylight. Accordingly, the film sound absorbing material in accordance with the invention is in this embodiment not level, and is curved according the shape of the tensioning means. A proper sound dampening effect may be achieved without preventing daylight from entering the compartment in the building. Yet another example of a field of use of the invention is dampening or diffusion of natural or artificial light entered or emitted from behind the film to spread the light uniformly throughout the room.

Accordingly, the present invention provides a lightweight material which is sound absorbing and at the same time translucent. This property is appreciated in use where inflow of daylight is desirable. Background illumination may also be arranged between the film and the structure it is mounted to. The material can be produced at low cost in an efficient manner with only a fraction (for example about 5%) of the material requirement compared to prior art sound absorbing elements. The film also exhibits good heat conductivity, a feature which is valuable inside buildings.

The sound absorbing film is produced with a device comprising a film feeding device, numerous laser cutting devices arranged to cut through slits in said polymeric film material, a film collection device arranged to collect film provided with microslits, and a control device arranged to control said film feeding device, film collection device and laser cutting devices. The film feeding device may be a roller that provides a continuous web of film. The film collection device may also be a roller that substantially continuously receives the film provided with microslits. It is also conceivable to cut the polymeric film after being provided with microslits. Alternatively, the film feeding device can be a conveyor that delivers discontinuous sheets of polymeric film pre-cut in a desired size, e.g., rectangular sheets of 100×120 cm. The laser cutting device may be any laser cutting device that enables through microslits of the dimensions described here to be cut in the polymeric film in question. In one embodiment, numerous laser cutting heads are attached to means that moves the laser cutting heads across the polymeric film during cutting. The method of production in accordance with the invention enables a fast and cost-effective production of sound absorbing material at a material cost heretofore not known.

The apertures in the film could have been provided as circular holes with regard to the sound absorbing effect. However, taken the desired degree of perforation into consideration, slits are highly preferred to circular holes, because a given degree of perforation requires a substantially higher number of holes. Production of circular holes would therefore slow down the production rate drastically, e.g. tenfold, because the laser devices would have to make a substantially larger number of welding operations and travel longer distance to perforate a given film area. Moreover, it should be mentioned that the laser production method in accordance with the present invention is able to produce highly predictable and accurate slit geometry compared to mechanically punched material.

FIGURES

Figure 1A:
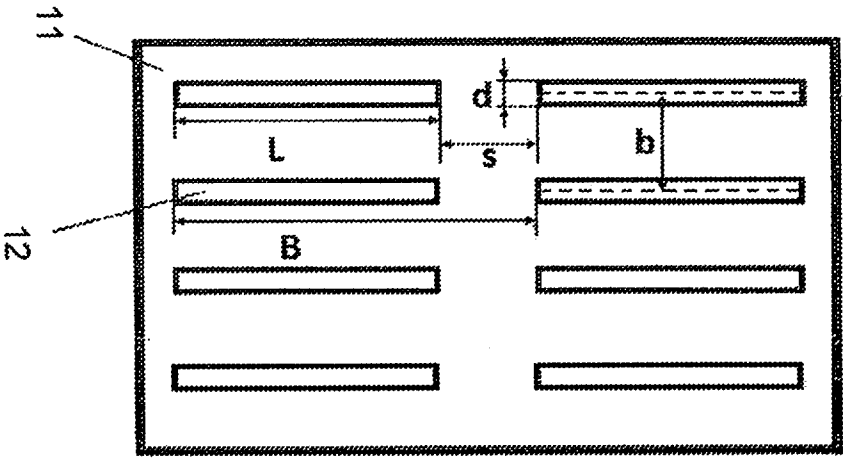
Figure 2:
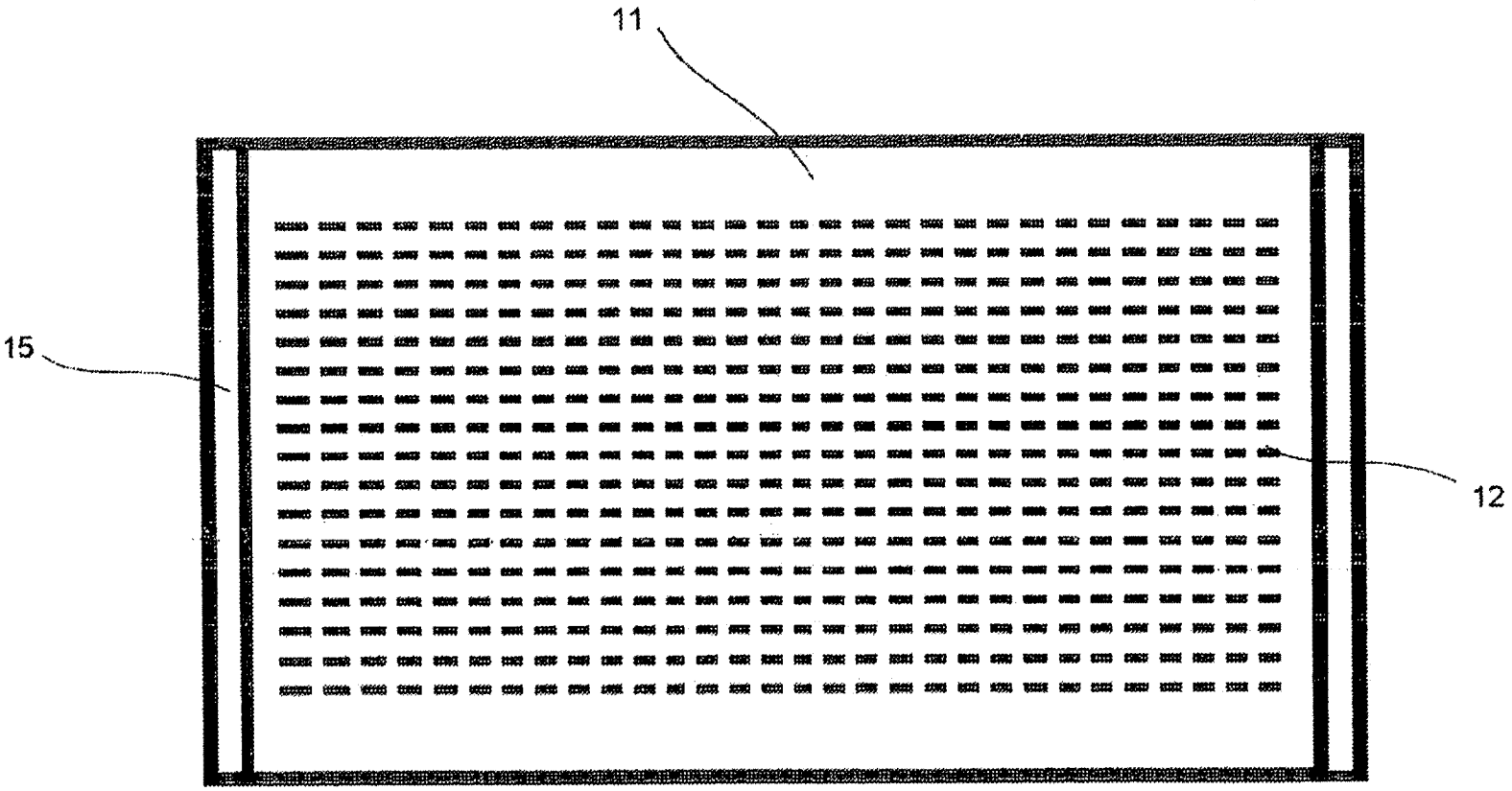
Figure 3:
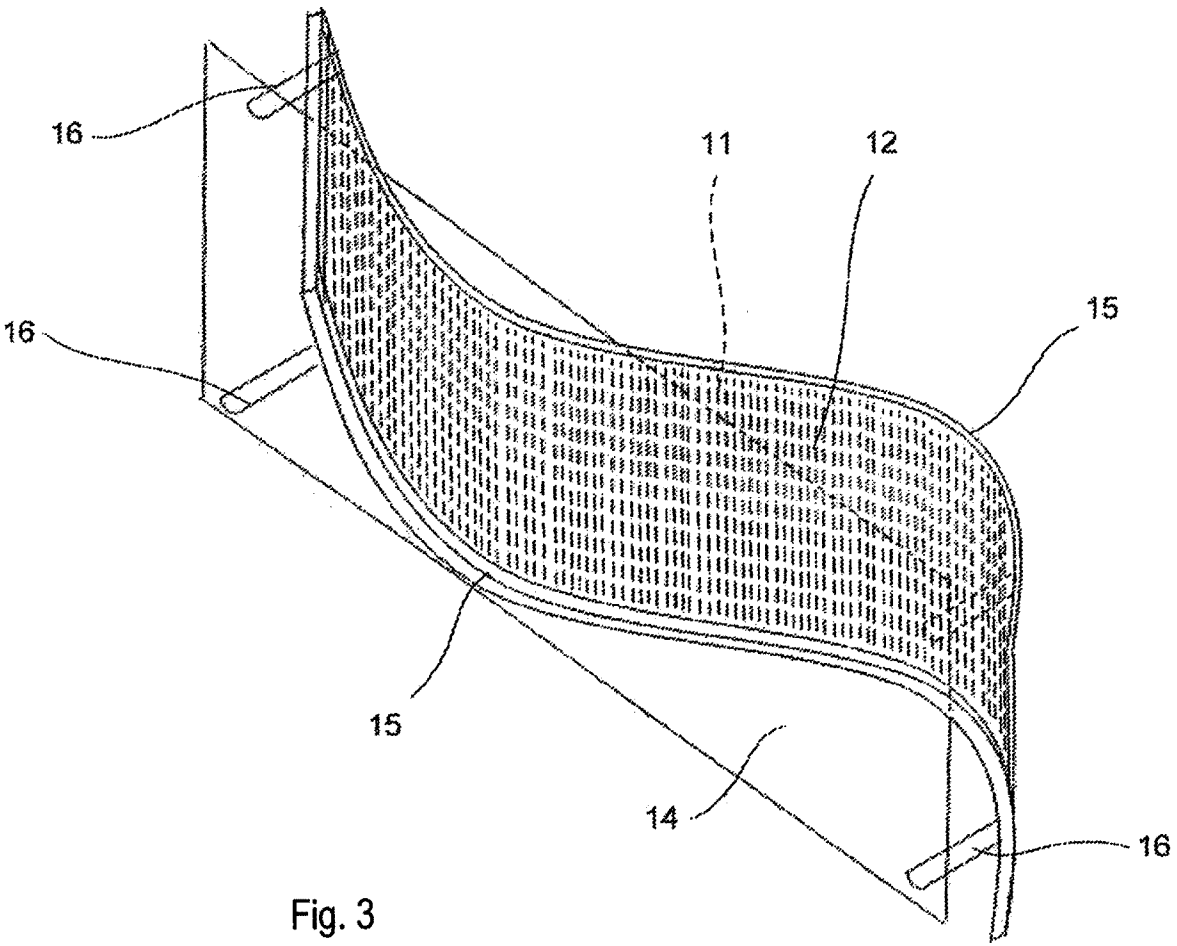

The invention is now described in further details with reference to Figures, where FIG. 1*a* illustrates a frontal view of the film with dimensions indicated, FIG. 1*b* is a cross section through the film, FIG. 2 shows a top view of one embodiment of a sound absorbing film in accordance with the invention, and FIG. 3 shows another embodiment of a sound absorbing film in accordance with the invention in perspective.

FIG. 1*a* illustrates a schematic section of a sound absorbing film 11 per se in accordance with the invention that illustrates one out of many different patterns for the microslits. Here, the microslits 12 are provided in a regular parallel pattern having a slit length L, a slit width d and a distance b to an adjacent (parallel) slit. The film thickness t is indicated in FIG. 1*b* and is typically within the range from about 0.1 to 0.3 mm, particularly about 200 μm. The slit length L is typically about 10-20 mm, particularly about 15 mm. The distance b between adjacent parallel microslits is typically about 4-8 mm, particularly about 6 mm. The distance s from the end of one microslit to the end of another is typically about 10-20 mm, particularly about 15 mm. The slit width d is typically about 0.05 to 0.15 mm, particularly about 100 μm.

FIG. 1*b* illustrates a schematic partial cutout area in a cross-section of the film of FIG. 1 mounted to a surface 14 in a space to be sound dampened. The sound absorbing film is arranged at a distance D from said surface 14, e.g., a ceiling or a wall, with attachment means (not shown). Air space between the sound absorbing film 11 and the surface 14 is indicated at 13. The distance D may vary according to the film characteristics and the environments, but typical values may vary from 8 to 20 cm, for example 15 cm, more preferred about 10 cm.

The degree of perforation calculated from the slit area to the total surface area of the film resides typically in the range of about 0.3-10%, preferably 0.3-5%, most preferably 0.3-3%. The figures above provide a proper sound dampening effect for most applications.

FIG. 2 show a schematic top view of one embodiment of a sound absorbing film 1 in accordance with the invention deployed as a rectangular sheet. The film 11 is provided with numerous microslits 12 arranged across a substantial part of the surface of the film 11. The film is tensioned within one or more fastening devices 16. The fastening device may be a frame or frame element, e.g. of wood or metal, or may advantageously be a resilient material, e.g. a flexible polymer sheet or textile. When being tensioned, the flexible fastening device which at least in part is encircling the film 11 will make the film more uniform and planar. Accordingly, the use of a resilient frame or sheet attached to the film along at least a part of the periphery of the film (at least at two opposite sides of the film) is a preferred embodiment. In the embodiment shown in FIG. 2, the film is provided with two fastening/mounting devices 15 at two sides of the film. Then, the microslits are preferably arranged with their longitudinal axis towards the fastening device 15. In other words, having a square or rectangular film 11, the longitudinal axis of the fastening devices 15 extend substantially perpendicular to the longitudinal axis of the microslits. However, the fastening device 16 may also surround the sound absorbing film 11. Further details of the fastening device should be within the scope of a person skilled in the art with support in the present specification. In this embodiment, the film surface is substantially level.

When mounting the sound absorbing material according to the invention on a wall, the slits are advantageously arranged with their longitudinal axis vertically. In this way, less area will be available for dust collection compared to a horizontal arrangement of the slits or a film having a large number of hole perforations.

Now referring to FIG. 3, another embodiment of the sound absorbing material is shown in perspective. Here the film material 11 is attached to and tensioned within a curved frame 16 attached to a surface 14 of a structural object in the building and at a distance therefrom via support and attachment means 16. Numerous substantially mutually parallel slits are indicated at 12.

Assembly

A method of assembling a sound absorbing film in a room in a building can be summarized as follows a) providing a sheet of the sound absorbing film provided with microslits, b) providing one or more mounting devices, c) tensioning the film within said mounting devices and affixing the film to the mounting devices to obtain a substantially level sheet, and e) attaching the microperforated film and mounting device to an object in the building, located at a distance D (FIG. 1*b*) from the object.

The distance D is typically about 50-200 mm, particularly about 100 mm.

Further details regarding mounting of the pre-fabricated versions of the sound absorbing films tensioned in a frame has been omitted here since it is considered to be within the reach of a person skilled in the art.

EXAMPLE

The effect of the present invention compared to prior art sound absorbing materials is presented in an example below. A sound absorbing test was conducted in accordance with ISO354 where sound absorbing effect of a sound absorbing material arranged at a certain distance from a hard surface, such as a wall or ceiling. The test is performed in a compartment having the required dimension and a known reverbation (which intentionally has been made longer than normal). Then, a minimum of a sound absorbing material is inserted, normally 10 $m^2$ whereupon a loudspeaker applies (white) nose into the room. Measurements performed on how fast all frequencies are dampened at 60 dB in the room. A similar measurement must be performed prior to insertion of the sound material to be tested for calibration purposes. The sound absorbing effect of the materials is calculated from the difference in reverbation with and without the sound absorbing material at the frequencies in question. The test is repeated numerous times to provide an average effect recalculated from reduced reverbation into a percentage sound absorption effect ranging from 0 to 100%, alternatively as a factor (in the table below referred to as Absorption Coefficient) ranging from 0 to 1 where 1 represents complete absorption and 0 represents no absorption.

An exception from ISO354 in this test was that the distance between the sound absorbing material and the hard surface of practical reasons was changed from 100 mm to 70 mm. The sound absorbing effect is practically the same.

A prior art sound absorbing material of polymeric material was provided. Its physical figures are summarized follows: thickness: 0.1 mm; hole diameter: 0.2 mm; hole spacing: 2.0 mm; and weight of the foil: 0.14 kg/$m^2$.

The sound absorbing material in accordance with the present invention had the physical figures as set forth below. Reference is made to the FIGS. 1*a* and 1*b* as well.

Film Thickness: t=180 μm

Slit Length: L=8 mm

Center-to-Center Distance Between Slits (y-direction): b=9 mm

Distance Between Adjacent Slits (x-direction): s=4 mm

Center-to-Center Distance Between Slits (x-direction): B=L+s=12 mm

Depth of Air Cavity Behind Panel: D=100 mm

Slit width is d=90 μm

| Frequency (Hz) | Absorption Coefficient (The invention) 100 mm—build height from reflective surface | Absorption Coefficient (Prior art) 100 mm |
|---|---|---|
| 125 | 0 | 0.05 |
| 250 | 0 | 0.1 |
| 500 | 0.2 | 0.45 |
| 1000 | 0.5 | 0.6 |
| 2000 | 0.6 | 0.35 |
| 4000 | 0.4 | 0.5 |

As can be seen from the table above, the sound absorbing material in accordance with the present invention exhibit an acceptable and competitive sound absorbing effect within the frequency range which is typical for noise within buildings from normal human activity, e.g. within a shopping mall.

Whereas the present invention has been described in the form of a single layered sound absorbing film, it should be noted that the invention is not limited to one single layer of the sound absorbing film and arrangement of multiple layers of the sound absorbing film is also conceivable. Moreover, the attachment means described in the embodiments above, such attachment frames, is not limited to the examples described. Any other attachment means can be used and will be within the reach of a person skilled in the art, such as double-sided tape attached to the sound absorbing film, welding of the film to another material, e.g. to a silicon list to be clamped to some other attachment means or object. Moreover, the fastening device may be provided in the form of a shade, including means to suspend the material from an object, and means to allow the polymer film to be drawn down from a rolled-up configuration to an extended configuration and fixed by fastening means or one or more weights. A configuration of this type provides stepless adjustable acoustics, e.g. in a room, with no sound dampening effect by the present invention in a fully uprolled configuration, to full sound dampening effect by the present invention in a fully extended configuration.

The invention claimed is:

1. A sound absorbing material suitable for use in rooms inside buildings for absorbing sound, said sound absorbing material comprising:

a continuous substantially translucent polymeric film (11) arranged with a fastening device (15), said film having smooth surfaces, with a thickness (t) of about 0.1-0.3 mm and provided with numerous discontinuous laser cut microslits (12) with a degree of perforation of from 0.3-10%, said microslits (12) exhibiting a length (L) of about 10-20 mm and a width (d) of about 0.05 to 0.15 mm, microslit arranged in a substantially parallel pattern, wherein the mutual distance (b) between substantially parallel adjacent slits is about 4-8 mm and the distance (s) between the short ends of adjacent slits (12) is about 10-20 mm wherein the film (11) is attached to a curved frame and tensioned to form an uneven curved film surface.

2. The sound absorbing material of claim 1, wherein the fastening device (15) is a continuous frame (15) surrounding substantially the whole periphery of the film (11), wherein the film is tensioned within the frame.

3. The sound absorbing material of claim 1, wherein the film (11) thickness (t) is about 0.2 mm.

4. The sound absorbing material of claim 1, wherein the slit width (d) typically is about 100 μm.

5. The sound absorbing material of claim 1, wherein the slit (12) length (L) is about 15 mm.

6. The sound absorbing material of claim 1, wherein the mutual distance (b) between substantially parallel slits (12) is about 6 mm.

7. The sound absorbing material of claim 1, wherein the distance (s) between adjacent slits (12) in their longitudinal direction is about 15 mm.

8. The sound absorbing material of claim 1, wherein the polymeric material is selected from the group consisting of PP, PE, PC and PS.

9. The sound absorbing material of claim 1, wherein the film is made of polypropylene comprising a halogen-free flame retardant containing calcium hydrophosphite as the main component.

10. A method of assembly of the sound absorbing material of claim 1 comprising:

a) providing a sheet of the sound absorbing material;

b) providing numerous mounting devices;

c) tensioning the sound absorbing material within said mounting devices and affixing the sound absorbing material to the mounting devices; and d) attaching the mounting devices and sound absorbing material at a distance (D) from an object in the building.

11. The method of claim 10, wherein the distance (D) is about 50-200 mm, particularly about 100 mm.

12. The method of claim 10, wherein several sound absorbing material layers are arranged on top of each other.

13. The method of claim 10, wherein the sound absorbing material is mounted to a substantially vertical object, with its microslits arranged with their longitudinal axis in a substantially vertical direction.

* * * * *